United States Patent [19]

Stromquist et al.

[11] Patent Number: 4,671,582

[45] Date of Patent: Jun. 9, 1987

[54] COMBINED, PLUG-IN HINGE PIN AND DOUBLE-ENDED ELECTRICAL CONNECTOR FOR A HINGED APPLIANCE DOOR, WITH MATING RECEPTACLE AND CONNECTORS

[75] Inventors: Michael E. Stromquist, Encino; Richard J. Richardson, Woodland Hills, both of Calif.

[73] Assignee: Anthony's Manufacturing Company, Inc., San Fernando, Calif.

[21] Appl. No.: 796,634

[22] Filed: Nov. 8, 1985

[51] Int. Cl.[4] ..... H01R 39/00

[52] U.S. Cl. ..... 439/31; 16/93 R

[58] Field of Search ..... 339/4; 16/93 R, 261, 16/262, 381, 386

[56] References Cited

U.S. PATENT DOCUMENTS

| | | | |
|---|---|---|---|
| 3,390,418 | 7/1968 | Sheridan | 16/93 R |
| 3,957,102 | 5/1976 | Kempel | 16/93 R X |

FOREIGN PATENT DOCUMENTS

| | | | |
|---|---|---|---|
| 970117 | 7/1975 | Canada | 16/262 |
| 1197584 | 7/1970 | United Kingdom . | |
| 1322428 | 7/1973 | United Kingdom . | |
| 1557646 | 12/1979 | United Kingdom . | |
| 1584028 | 2/1981 | United Kingdom . | |
| A2081372 | 2/1982 | United Kingdom . | |
| A2121101 | 12/1983 | United Kingdom . | |
| A2128242 | 4/1984 | United Kingdom . | |

*Primary Examiner*—Eugene F. Desmond

*Attorney, Agent, or Firm*—Poms, Smith, Lande & Rose

[57] ABSTRACT

A hinge pin is described for an appliance door which combines the functions of a plug-in, mechanical hinge pin and bearing member for the door, adaptable for either right-hand or left-hand opening doors, with that of an electrical connector to bring power into the door without the need of a separate, external service loop to the door. A frame-mounted mating receptacle is provided in the combination for sliding engagement of the hinge pin and plug with the appliance in two embodiments permitting a "universal", side-by-side mounting of two or more doors. Electrical connectors are included for engagement with the hinge pin and plug combination, both at the appliance frame and within the door.

14 Claims, 15 Drawing Figures

Fig. 5.
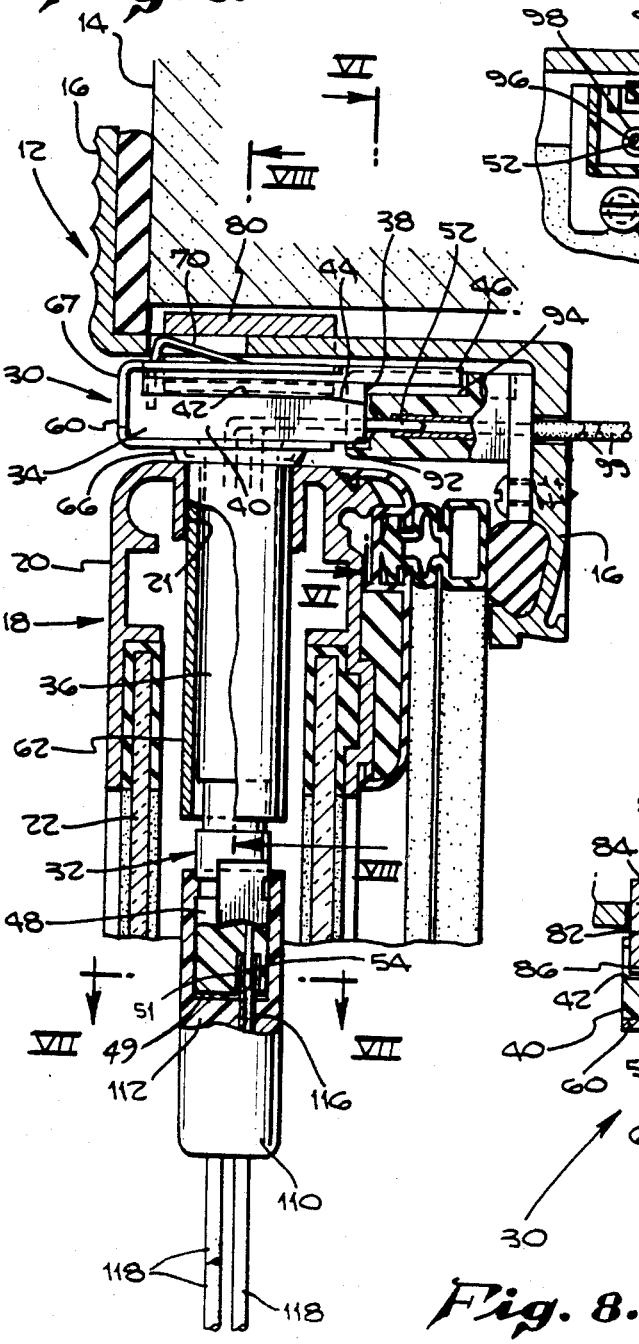
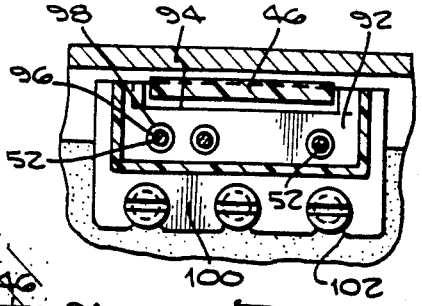
Fig. 6.
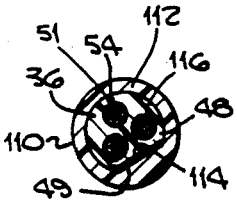
Fig. 7.
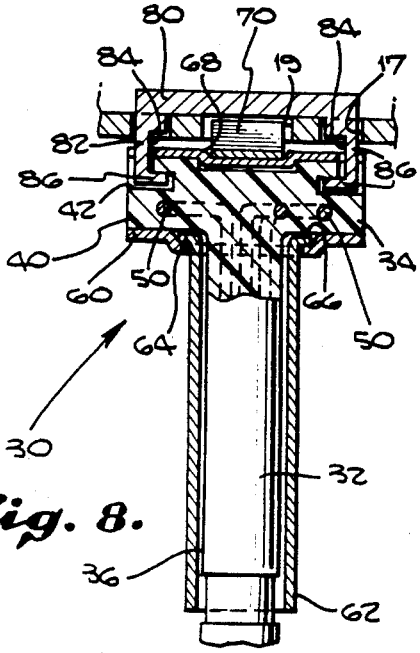
Fig. 8.

COMBINED, PLUG-IN HINGE PIN AND DOUBLE-ENDED ELECTRICAL CONNECTOR FOR A HINGED APPLIANCE DOOR, WITH MATING RECEPTACLE AND CONNECTORS

BACKGROUND OF THE INVENTION

1. Field of the Invention

This invention relates, in general, to hardware for appliances, and in particular, to a device which combines the functions of a plug-in, hinge pin for an appliance door and means for bringing electrical power into the door, for use on refrigerators and the like.

2. Summary of the Prior Art

Commerical refrigerators and refrigerated display cases are employed in markets, food-vending operations, liquor stores and the like for the simultaneous preservation of freshness and attractive display of foodstuffs to the customer. Typically, commercial display cases have large, swinging doors which incorporate large areas of multiple-layered glazing to permit the customer to see, select and access the refrigerated product easily, while preventing a heat loss into the refrigerated space.

Unfortunately, humidity conditions can develop within and/or without the unit which cause condensation to form on the glazed portions of the door, which inhibits a clear view of the product by the customer. This problem has been overcome by the installation of small-wattage heaters within the door, sometimes on the glasing itself, which are thermostatically activated to evaporate or prevent the moisture, resulting in enhanced visibility through the door.

As a consequence of the need for electrical heaters, it becomes necessary to bring electrical power into the door itself, which is typically hinged at the top and bottom corners of one vertical edge of the door by means of a fixed hinge pin passing into a bearing opening withint the frame of the door. Typically, this connection of the door with electrical power is accomplished by means of a "service loop", i.e., a loop of two or more conductors exiting a point on the frame of the appliance and connecting by means of a male/female connector combination either at some point on the surface of, or within, the swinging door. Aside from the cosmetic, or appearance, problem that this may present, the service loop is required to undergo a flexion each time the door is opened and closed by the customer, leading to wear and tear on the conductors over a period of time. An additional problem presented by this method is that of having the conductors exposed to the external surface of the door and appliance, which renders them subject to abrasion and impact by passing objects.

Although efforts have been made to overcome some of the foregoing problems by encapsulating the service loop conductors within flexible conduits which serve to protect and dress up the external aspect of the conductors, it would be more desirable if the electrical connection could be contained entirely within the frame or mounting structure of the refrigerator and the door itself.

Another, related problem with hinged appliance doors is that of their quick removal and replacement for maintenance and repair. Conventionally, the hinge pins for the door are carried on brackets which are installed and removed by the use of threaded fasteners and conventional hand tools. Also typically, this hardware is not designed to be reversible, i.e., usable on appliances which are adapted to have either "right-hand opening" or "left-hand opening" doors. Thus, it would be desirable to have a hinge pin which could be simply and quickly plugged or snapped into a mating receptacle in the appliance, which is adapted for either right-hand or left-hand applications, and which incorporates integrally the function of an electrical connection for the door, thereby eliminating any need for a separate, external service loop.

SUMMARY OF THE INVENTION

It is, therefore, an object of the present invention to provide a plug-in hinge pin for hinging a door to a door-frame which is adapted for both right-hand and left-hand opening doors.

Another object of the present invention is the provision of such a plug-in hinge pin which incorporates a means for making plug-in electrical connection for a hinged-appliance door having an electrical power requirement.

Yet another object of the present invention is to provide a mating receptacle, suitable for installation on the above appliance, to receive the combination plug-in hinge pin and electrical plug.

It is yet another object of the present invention to provide such a device in an embodiment that is relatively inexpensive to manufacture and install, yet which achieves the requisite degree of reliability in demanding commercial use.

These objects are preferably achieved in a plug-in hinge pin assembly comprising an upper, plug part having a quick-disconnect latching member thereon for mechanical engagement and retention with the frame of the appliance, and a lower hinge pin which extends orthogonally-outward therefrom and into a bearing hole contained in the edge of the door. The assembly may further comprise a plurality of electrical conductors, which extend outwardly from the front of the plug part to form an electrical plug for electro-mechanical engagement with the frame of the appliance, and downwardly from the face of the hinge-pin to form a male plug within the door, the combination thus formed being adapted for mating with an electrical connector contained within the door and a mating receptacle mounted on the frame of the appliance to receive, and to mate with, the plug-in hinge-pin and connector assembly.

In a second embodiment, a ganged receptacle permits the side-by-side, plug-in hinging and electrical connection of two or more doors on a larger appliance in which the doors may be adapted to open in opposite directions.

These and other objects and advantages will become evident to those skilled in the art from a consideration of the following specification, when taken in conjunction with the drawings, the following of which is a brief description.

DESCRIPTION OF THE DRAWINGS

FIG. 5 is a sectional view taken through the side of the subject of the present invention, showing the plug-in hinge pin and double-ended electrical plug installed within its mating receptacle and connector of the first embodiment, which are mounted to the frame of the appliance, also showing the hinge part of the combination extending into the door, where it mates with a socket contained within the door, as revealed by the section V—V taken in FIG. 2;

FIG. 6 is a detailed section through the mating face of the combination hinge pin and plug and its mating, chassis-mounted connector, as revealed by the section VI—VI taken in FIG. 5;

FIG. 7 is a detailed section through the hinge pin portion and mating female socket contained within the door, as revealed by the section VII—VII taken in FIG. 5;

FIG. 8 is a sectional view looking into the rear cross section of the subject of the present invention, as revealed by the section VIII—VIII taken in FIG. 5;

DESCRIPTION OF THE PREFERRED EMBODIMENTS

Figure 1:
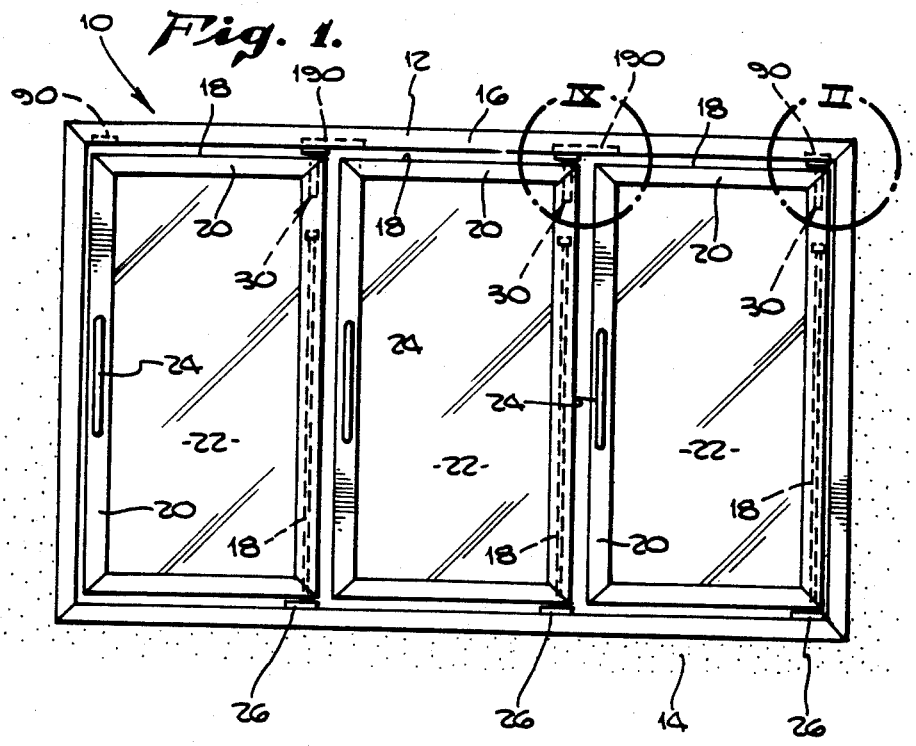
FIG. 1 is a front view of a typical refrigerated display case having three, right-hand-opening doors, each having a large, glazed area for product viewing, and in which detail sections II and IX are taken.

FIG. 1 illustrates the front view of a refrigerated display case 10 typically found in markets, liquor stores, convenience stores, and the like. These cases may be fabricated on a custom or semi-custom basis, in which the display unit 12 of the case is incorporated into the framing elements 14 of the refrigerated space, which is maintained at a lowered temperature by conventional refrigeration equipment. The refrigerated display case 10 may contain one or more double-glazed, swinging doors, and in FIG. 1, three, right-hand opening doors 18 are illustrated, each having double-glazed viewing areas 22.

It is usual to fabricate the elements of the frame 16 of the display unit 12, as well as the frame elements 20 of the hinged doors 18, from mitered extrusions, usually aluminum, which are joined at the corners. This enables a significant amount of detail features to be incorporated into the extrusion die, such as the gasket channels, bearing apertures, etc.

Typically, glazed doors 18 are provided with a handle 24 and are hinged at the top and the bottom corners of one vertical edge for swinging outward. The lower hinge element 26 typically carries the vertical loads in the door, including the weight of the door, and both hinges must carry lateral loads applied to the door, including dynamic loads imposed on the door during opening and closing. Doors 18 can additionally be provided with torque rod assemblies 28, or other spring-return mechanisms, to return doors 18 to a closed position automatically.

Figure 12:
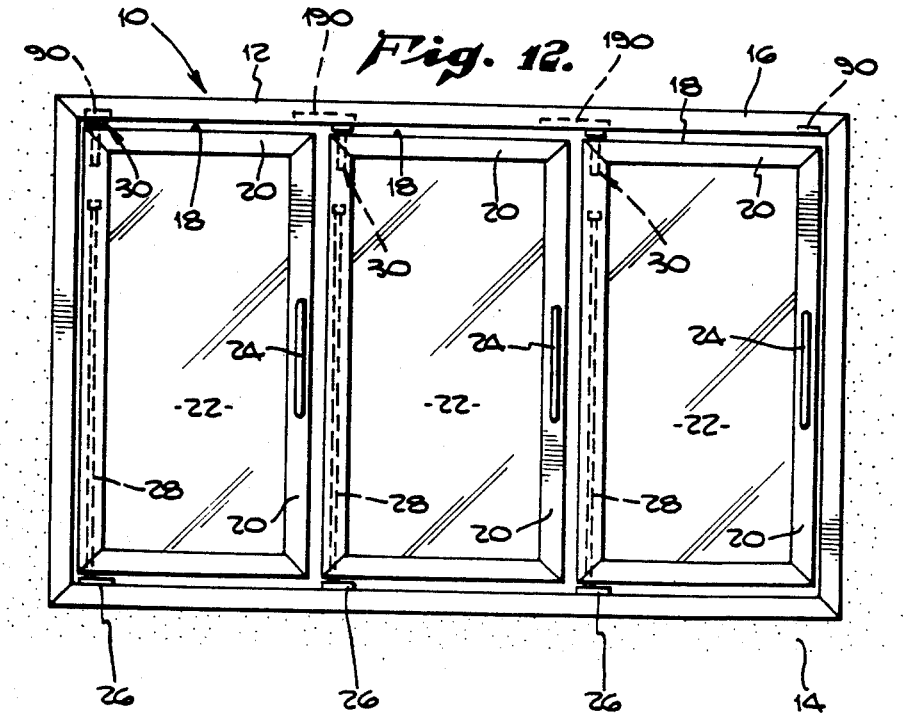
FIG. 12 is a front view of a large, refrigerated display case having three glazed doors which are hinged for left-hand opening.
Figure 13:
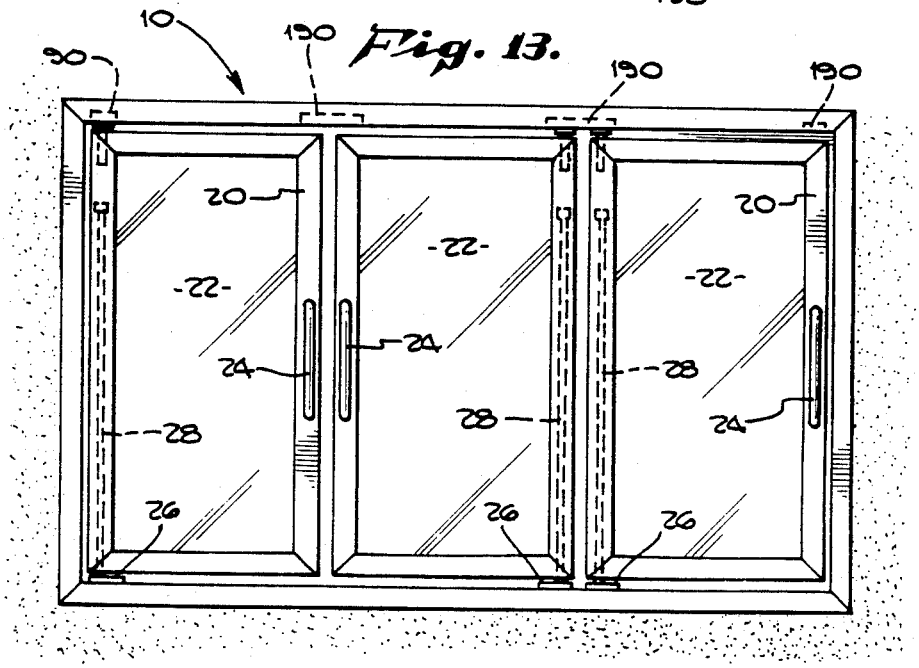
FIG. 13 is a front view of a large, refrigerated display case having three glazed doors, two of which are hinged for right-hand opening, and one of which (center door) is hinged for left-hand opening.

As indicated above, it is desirable to provide that doors 18 be adapted for either right-hand opening (illustrated in FIG. 1) or left-hand opening (illustrated in FIG. 12), without a need for extensive modification. Additionally, it may be desirable to have a given pair of adjacent doors open in opposite directions to one another, such as is illustrated in FIG. 13. Further, it would be desirable if at least one of the hinging members could be made engagable with the frame 16 of display unit 12 in a quick-release, plug-in fashion, such that the doors 18 could be quickly removed and replaced for repair and maintenance purposes.

Finally, it is desirable to eliminate the "pig-tail" service loop associated with doors having an electrical power requirement, such that the power connection to the door is made integral with the door and in a safe and reliable fashion.

It has been discovered that the foregoing requirements can be met by a combination plug-in hinge pin and double-ended electrical plug, with a frame-mounted, mating receptacle and connector therefor, combined with an electrical socket contained within the door.

A first preferred exemplary embodiment of such a device is illustrated in FIGS. 2–8 of the drawings.

Figure 4:
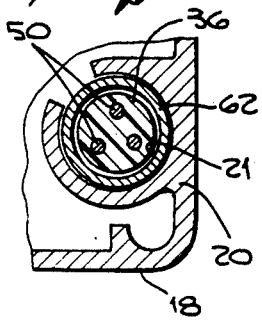
FIG. 4 is a detailed section taken through the hinge pin portion of the hinge pin and plug combination residing within the bearing aperture contained within the frame of the door, as revealed by the section IV—IV taken in FIG. 2.
Figure 9:
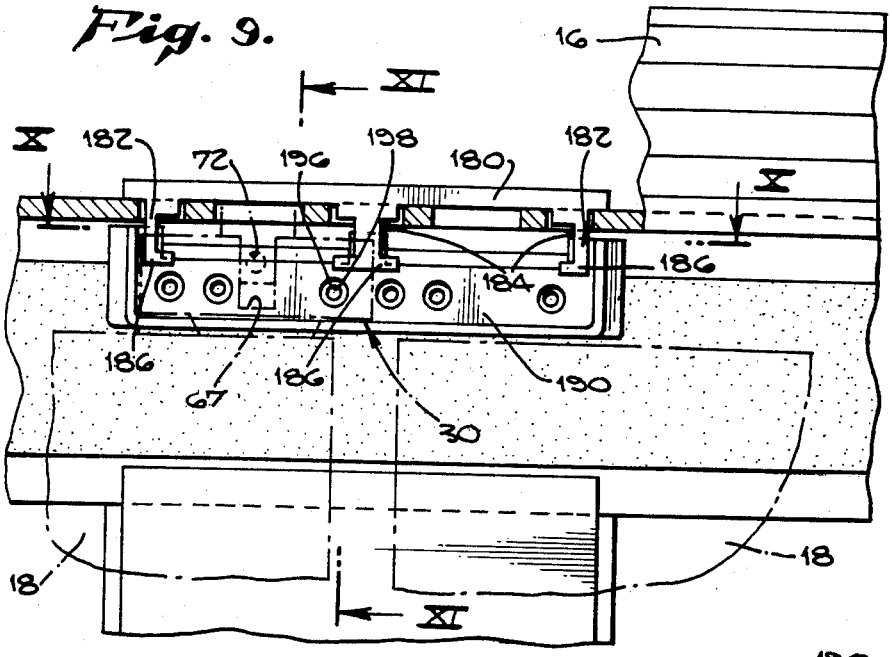
FIG. 9 illustrates a second embodiment of the subject of the present invention, a ganged receptacle permitting the side-by-side installation of a pair of doors in which both doors are right-hand-opening, as revealed by the detail section IX taken in FIG. 1, but which may be quickly changed over to accommodate a pair of side-by-side, oppositely-opening doors, as is shown in FIG. 13.
Figure 10:
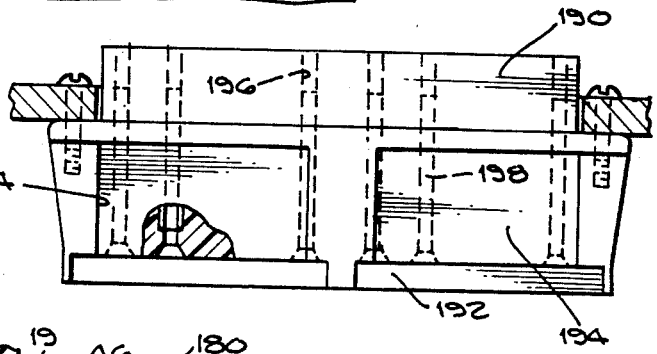
FIG. 10 is a sectional view looking down through the female connector of the second embodiment, as revealed by the section X—X taken in FIG. 9.

FIG. 5 shows a sectional view through the side of the first embodiment, in which display unit 12 is seen mounted in the insulated construction wall 14 of the refrigerated space. Framing element 16 of display unit 12, as well as framing element 20 of the door 18, are seen in cross sections. Door frame 20 includes a bearing aperture 21 to receive the hinge pin element from the hinging combination, and can be a detail which is extruded into door frame 20 at the time of fabrication. This detail is best illustrated in FIG. 4.

Installed in bearing aperture 21 in a sliding fit is a combined plug-in hinge pin and double-ended electrical plug assembly 30. The combined hinge pin and plug assembly 30 includes a single, molded insulator body 32 having an upper, rectangular part 34 and a lower, cylindrical hinge-pin part 36 extending orthogonally downward therefrom. In the preferred embodiment illustrated, the insulator body 32 is preferably molded from a single piece of plastic material, e.g., a polycarbonate or polytetraflouroetheylene.

The upper part 34 of insulator body 32 includes a vertically-planar, front connector face 38 and a pair of vertical, parallel, planar side surfaces 40. Side surfaces 40 each contain a sliding groove 42 which extends to front connector face 38, each having a lead-in taper 44 at it front edge. Additionally, upper part 34 includes a forward-extending, mating tongue 46 molded into its upper surface.

The lower, hinge-pin part 36 of insulator body 32 is substantially cylindrical in cross section and includes a lower end 48 adapted into the configuration of a male connector plug, including a horizontal, downward-facing plug face 49.

A plurality of electrical conductors 50 (FIG. 8) extend from the front connector face 38 of insulator body 32 down to the horizontal connector face 49 of hinge-pin part 36. In the preferred embodiment, these conductors are formed from solid, annealed copper, are gold plated, and are terminated at either end in male contact pin ends 52 and 54 at their upper and lower ends, respectively. In the preferred embodiment, conductors 50 are pre-bent into the desired configuration and placed into plastic, molded carriers (not shown) which hold the conductors 50 in the desired orientation in the mold of insulator body 32. Insulator body 32 is then "molded around" the conductors 50, except for a short length of exposed conductors 50, including male contact pin members 52 and 54. Upper male contact pin members 52 are left exposed to extend orthogonally outward for a predetermined length from plug face 38, while lower male contact pin members 54 are each contained within a recess 51 provided within lower end 48 of insulator body 32 which open through downward-facing plug face 49 to form a protective sheath about lower male contact pin members 54. In this manner, conductors 50 are rigidly retained within insulator body 52 while being electrically isolated from the rest of the hinge pin and plug assembly 30. Additionally, the protective sheath formed around lower male contact pin members 54 prevents accidental shock by contact with them when upper male contact pin members 52 are energized.

Insulator body 32 is further reinforced at its top by a wraparound, C-shaped reinforcing member 60, and at its bottom by a tubular-shaped, bearing sleeve 62 which contains the hinge-pin part 36 of insulator body 32 within it in a fit which permits the sleeve 62 to rotate.

Bearing sleeve 62 is drawn or rolled from metal sheet stock and includes a flange 64 formed into its upper end (see FIG. 8). Wraparound reinforcing member 60 is stamped from a single piece of metal sheet stock, then formed into the configuration shown. The lower finger of reinforcing member 60 contains an aperture which is dimpled downward to form a recess 66 to receive the upper flange 64 of bearing sleeve 62. The upper finger of reinforcing member 60 includes an embossed surface 68 in which an over-center latching member 70 is mounted.

During assembly, insulator body 32 (with conductors 50 already molded in) is inserted into bearing tube 62, which, in turn, is then inserted through the aperture in the lower finger of reinforcing member 60 such that flange 64 rests within dimpled recess 66 and the lower surface of upper part 34 rests on the upper surface of the lower finger of reinforcing part 60 (see FIG. 8). The upper finger of reinforcing part 60 is then folded down over the upper surface of upper part 34, the over-center retaining member 70 is placed within the recess 68 of reinforcing member 60, and a single fastener 73 is installed to hold the various parts together in the finished hinge pin and plug assembly 30.

Bearing sleeve member 62 serves a three-fold function within the hinge pin and plug assembly 32. First, having an internal diameter slightly larger than that of hinge pin member 36, it is free to rotate thereabout and with door frame element 20, including the internal surface of bearing aperture 21. Thus, the entire internal surface of sleeve 62 and the entire external surface of hinge pin part 36 are made to serve as bearing surfaces to reduce hinge friction (see FIG. 4).

Second, since flange 64 of bearing sleeve 62 is retained in the dimpled recess 66 between upper part 34 and the lower finger of reinforcing part 60, bearing sleeve 62 serves to distribute lateral loads from door 18, which would otherwise be incident solely upon hinge pin part 36 alone, into the upper part 34 of the hinge pin and plug combination, where those lateral forces are distributed to the frame 16 of display unit 12.

Finally, since some misalignment may exist between the hinge pin and plug assembly 30 and its appliance-mounted mating receptacle due to an axial misalignment of the bearing hole 21 in door 18, bearing sleeve 62 imparts a degree of flexibility to the hinge pin portion of assembly 30, to permit it to bend slightly with respect to the upper part of the assembly while it is engaged within its receptacle, to accommodate the misalignment.

Over-center latching member 70 includes an inclined-plane upper surface terminating in a inverted V which is sprung outward from the upper surface of hinge pin and plug assembly 30. The rear-facing leg of latching member 70 includes a tool-gripping aperture 72 therein which is accessed when the assembly 30 is installed through the surface of reinforcing member 60, which is bifurcated at its rear-facing edge in an opening 67 to permit a tool to be inserted therein to engage and depress latching member 70, to release the device for removal (see FIG. 2).

Figure 2:
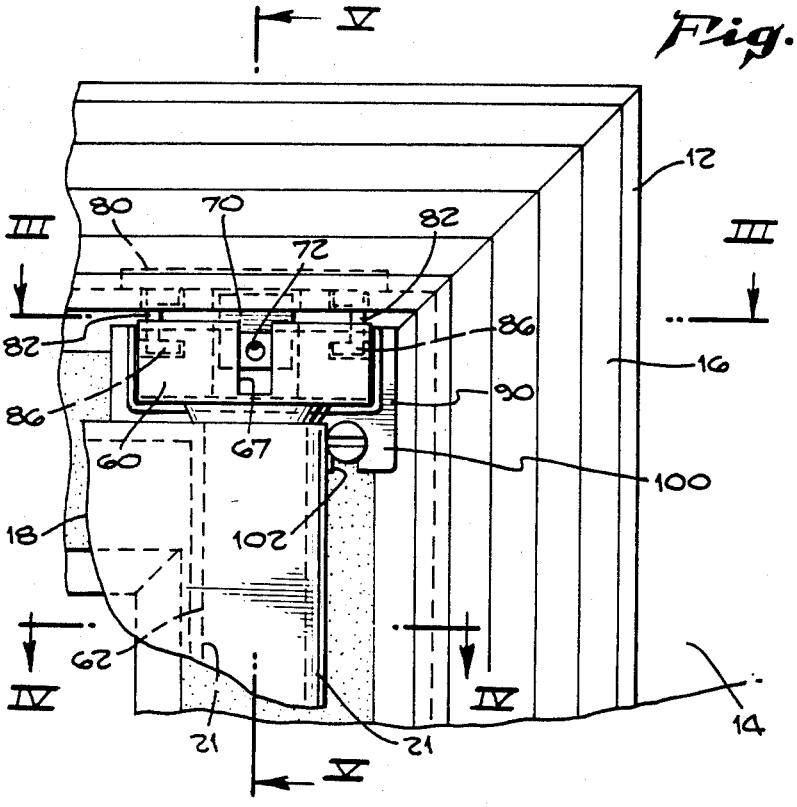
FIG. 2 is the detail view of the rear surface of an installed combination hinge pin and double-ended electrical plug of the present invention, as revealed by the section II taken in FIG. 1.
Figure 3:
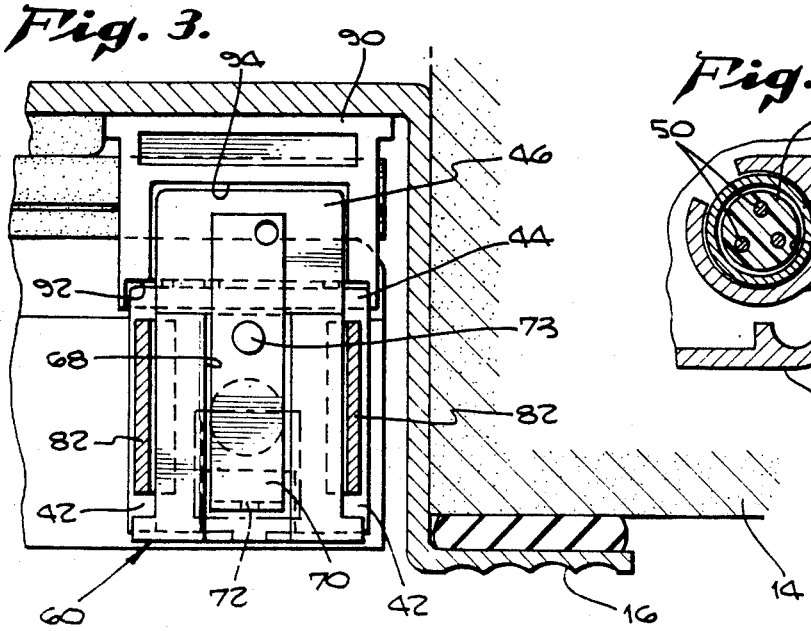
FIG. 3 is a detailed section through the top of the installed hinge pin and connector combination, showing its engagement in a mating, appliance-mounted receptacle of the first embodiment; as revealed by the section III—III taken in FIG. 2.

The upper, male plug portion of the combined hinge pine and double-ended plug assembly 30 mates and engages within a frame-mounted receptacle 80 and female connector assembly 90 (see FIG. 2).

Plug-in receptacle 80 comprises a simple, open-channel part, and in the preferred embodiment, is extruded from a strong, corrosion-resistant metal, such as an aluminum alloy (see FIG. 8). Receptacle 80 includes a pair of sidewalls 82 which extend vertically downward through apertures 17 in display frame 16. Vertical sidewalls 82 include a pair of opposed, parallel sliding grooves 84 which serve to receive sliding tongue member 46 of hinge pin and plug assembly 30. Additionally, the vertical sidewalls 82 of receptacle 80 include a pair of horizontal, opposed, parallel fingers 86 which engage the horizontal grooves 42 in the side surfaces 40 of the upper part 34 of insulator body 32 for sliding engagement therewith. A recess 19 contained in frame element 16 of display unit 12 serves to receive and retain the over-center latching member 70 when hinge pin and plug assembly 30 is installed in a plug-in fashion.

Mating connector 90 is also frame-mounted and includes a molded insulator body, preferably of plastic, having a mating front connector face 92 and an upper groove 94 to receive the tongue 46 of upper body 34 of hinge pin and plug assembly 30 for alignment and sliding engagement (see FIGS. 3, 5, 6 and 14). Connector 90 includes a plurality of sockets 96 which contain female sliding-contact connector sleeves 98 which are terminated at their rear ends in flexible wires 99 of conventional type contained internally in the framing element 16 of display unit 12. Connector 90 is frame-mounted by means of a mounting flange 100 containing a plurality of fastener slots 102 (see FIG. 6).

The lower end of hinge pin part 36 contains a male plug end 48, keyed to be mated with a mating socket 110 contained within the framework of the door 18 (see FIG. 5). Mating socket 110 includes an insulator body 112, preferably of rubber material, which permits it to be molded slightly undersized for a press, slip-fit over male end 48 of hinge pin member 36. Socket 110 contains a keying feature 114 molded into its internal face to align it with the keying feature on the plug end 48 of hinge pin part 36. It is desirable that the depth of the socket 110 and the keying feature 114 be such that proper alignment is made between male pin ends 54 of conductors 50 and female contact sockets 116 contained within socket 110 before electrical contact is made at the pins, to prevent possible electrical shorting during initial engagement. Female contact sockets 116 extend upwardly within mating socket 110 for a length sufficient to permit them to engage lower male contact pin members 54 within protective sheath recesses 51 and are terminated at their rear ends in conventional, flexible, insulated conductors 118 which extend to elements within the door requiring electrical power. It is intended that socket 110 be hand-mated with the male plug feature 48 of hinge pin and plug assembly 30 during installation of hinge pin and plug assembly 30 into door 18. A cross section view through the mating plug 48 and socket 110 combination is shown in FIG. 7.

FIGS. 9–11 and 15 illustrate a second exemplary preferred embodiment of the present invention, differing only in the details of the receptacle and mating connector which are frame-mounted to display frame 16. In this embodiment, the receptacle feature and the mating connector feature of a side-by-side pair of doors is combined into a single, "ganged" receptacle 180 and mating connector 190. As before, receptacle 180 is in the form of an open-channel, extruded part, except that a central wall 183, having oppositely-faced sliding grooves 184 and oppositely-faced sliding fingers 186, is provided integral to the part to form a pair of side-by-side channels.

Figure 15:
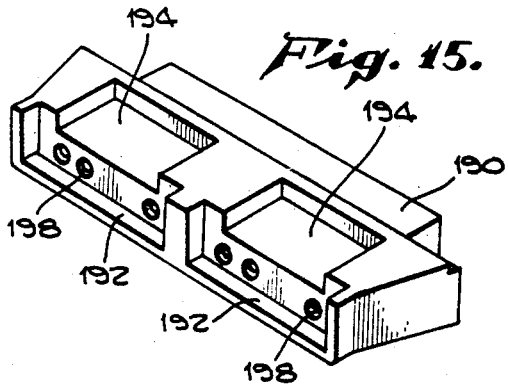
FIG. 15 is a front perspective view of the connector of the second preferred embodiment.

Similarly, ganged mating connector 190 integrates the function of a pair of single mating connectors 90 in a side-by-side configuration (see FIG. 15). By implementation of one or more of the second preferred embodiment within the display unit 12, as illustrated in FIGS. 1, 2 or 13, two or more doors may be quickly installed side-by-side and in any opening-configuration desired, and thereafter altered to suit the customers' preference without the need for extensive reworking or modification of the display unit 12 or door 18.

Figure 11:
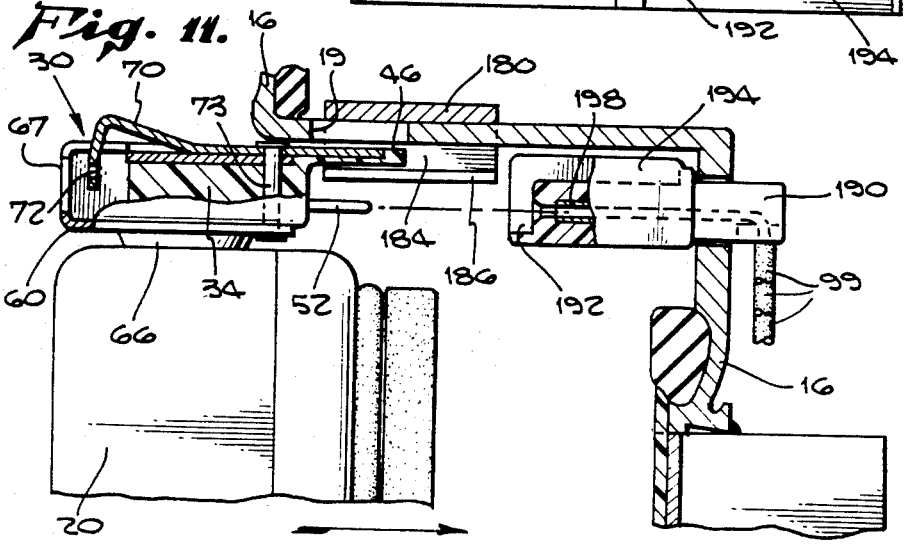
FIG. 11 is a partial sectional view taken through the side of the second preferred embodiment of the present invention, sowing the door-mounted plug and hinge pin combination moving in the direction of the arrow to achieve plug-in, electromechanical mating with the appliance-mounted receptacle and mating connector of the second embodiment, as revealed by the section XI—XI taken in FIG. 9.
Figure 14:
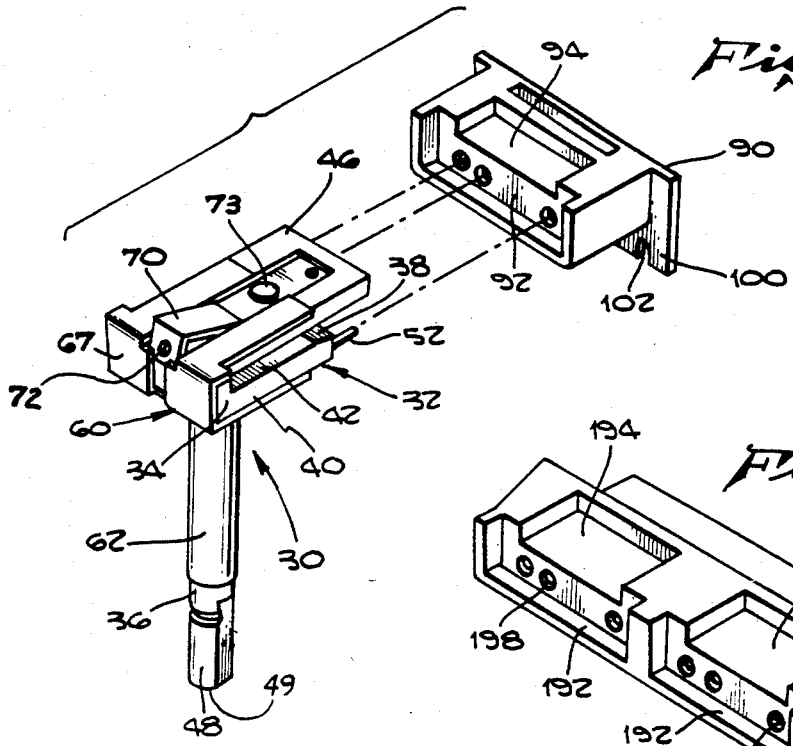
FIG. 14 is a perspective view of the combination hinge pin and double-ended electrical plug of the present invention shown in alignment with the connector of the first preferred embodiment.

FIG. 11 shows the installation of a door-mounted hinge pin and plug assembly 30 into a mating receptacle 180 and mating connector 190 of the second embodiment in the direction of the arrow.

It is contemplated that, in actual use, the assembled hinge pin and double-edged plug 30 will be installed in the upper corner bearing aperture 21 of a separate door 18. Socket 110 is then manually installed on the male plug portion 48 of the hinge pin and plug assembly 30 within door 18 by means of an access panel (not shown) at the upper corner of door 18. A lower hinge pin 26 on door 18, which may include torque-rod return mechanism 28, already installed, is then inserted within display frame 16 to engage the door at the bottom and support the weight of the door. The upper corner of the door 18, containing the installed hinge pin and plug combination 30 is then swung inward toward the frame-mounted receptacle 80 or 180 and the tongue 46 of upper part 34 rotated into alignment with the opening of receptacle 80 or 180. The door is then simply pressed forward, which causes the hinge pin and the plug assembly 30 to be engaged by its respective mating surfaces in receptacle 80 or 180 and mating socket 90 or 190 until over-center latching member 70 is received into detent 19 within display frame 16. Removal of the door is a simple reversal of the above-recited operations, preceded by the insertion of a tool into the aperture 72 in latching member 70 to depress it, forcing it downward and out of detent 19, which permits the door to be unplugged rearwardly from its electromechanical connection with the frame 16.

If display case 12 has previously been suitably supplied with mating receptacles and connectors, as illustrated in FIGS. 1, 2 or 13, it is a simple matter to change over any door from a right-hand opening door to a left-hand opening door, or vice-versa, by removing the door 18 from the display 12, re-positioning the hinge pin assemblies 26 and 30, and reinstalling the door 18 into display 12 by the steps outlined above.

Similarly, it is to be noted that the combination illustrated in the first and second preferred embodiments can be easily modified for use with appliances which do not require electrical power in the door by simply omitting conductors 50 from hinge pin and plug combination 30, as well as mating connectors 90 and/or 190 from display frame 16, and socket 110 from door 18. If it later becomes desirable to bring electrical connections to the door, then the connectors 90 and/or 190 can simply be installed into display frame 16, along with a socket 110 within door 18, and a hinge pin and plug combination 30 can easily be substituted for the one which lacks conductors.

In the two preferred embodiments illustrated in the figures, three conductors have been shown for purposes of illustration, including two conductors to carry a hot leg and a ground leg of a typical power circuit, with a third conductor for separate grounding of the frame. However, those skilled in the art will recognize that the number of conductors 50 and their orientation can be modified easily to include a greater or lesser number, or omitted altogether. Likewise, while the upper body 34 of the combined hinge-pin and connector assembly has been illustrated as being substantially rectangular in cross section, this is for exemplary purposes only and other configurations, e.g., round, tapered, etc., may be more suitable for some applications, and still fall within the spirit and scope of the present invention. Finally, the materials, methods of fabrication and sizes depicted are for illustration purposes only and can be modified by skilled practitioners to achieve a variety of applications and requirements.

Accordingly, our invention, a combination plug-in hinge pin and double-ended electrical plug for a hinged, right-hand or left-hand opening appliance door, with mating receptacle and connectors therefor, should be limited only by the following claims.

We claim:

1. A combined hinge pin and double-ended electrical plug for hingably-attaching and electrically-connecting a door in a mating receptacle on a door frame, comprising:

a plug body adapted for sliding engagement in a fore-and-aft direction with said mating receptacle, having a front-facing, first electrical plug face for forward electromechanical engagement with said mating receptacle and at least one lateral surface for lateral mechanical engagement with said mating receptacle, for transmitting lateral forces from said door to said door frame;

fastening means for fastening said plug body in said fore-and-aft, sliding engagement with said mating receptacle;

a hinge pin for hinging said door to said door frame, extending outward from said plug body in a direction normal to said fore-and-aft direction and into said door, said hinge pin terminating in an outward-facing, second electrical plug face within said door; and electrical conductor means extending internally of said plug body and said hinge pin for conducting electrical power from said first electrical plug face to said second electrical plug face, further including electrical insulator means for insulating said conductor means from said plug body and said hinge pin.

2. The device of claim 1, wherein:

said plug body and said hinge pin are molded as a generally solid, single piece of rigid, electrically-inslulating material.

3. The device of claim 2, wherein:

said electrical conductor means further includes at least one electrical conductor molded into said electrically-insulating material and extending from said first plug face to said second plug face.

4. The device of claim 3, wherein:

said electrical conductor has a first end extending orthogonally-outward from said first plug face for a predetermined length, a second end extending downward into an open-ended recess formed into said second plug face, and wherein said conductor is terminated at either end in a male-connector pin-end.

5. The device of claim 1, wherein:

said plug body is substantially rectangular in cross section, having a pair of oppositely-facing sides, each side containing a horizontal groove therein extending to said first plug face, with a tapered entry thereat for sliding engagement with said mating receptacle.

6. The device of claim 1, further comprising:

a tubular bearing sleeve rotatably-retained about said hinge pin for insertion into said door, for reinforcing said hinge pin against lateral forces applied to said hinge pin by said door and for reducing rotational friction between said door and said hinge pin body.

7. The device of claim 6, wherein:

said fastening means further includes a combination leaf spring and over-center latching member attached at one end to said body, said latching member having an inclined-plane forward surface, the outermost portion of which is formed into the apex of an inverted, acute angle, which is sprung outwardly from said plug body, said latching member further having a tool-gripping feature on its rear surface for grasping said latching member and for forcing it inwardly to release said member from engagement; and wherein said door frame and/or said receptacle contains a detent in their outer surface to receive and engage said over-center latching member therein.

8. A plug-in hinge pin and double-ended electrical plug, and a mounting receptacle and mating sockets therefor, for hinging a door having an electrical power requirement to a door frame, comprising:

a plug-in hinge pin and double-ended electrical plug assembly, including:

a T-shaped, electrically insulating body having an upper part and a lower part, said upper part consisting of an oblate cuboid having horizontally-planar upper and lower surfaces, a vertical front plug face, a vertical rear face and a pair of vertical sides, each said vertical side containing a horizontal groove therein extending to said front plug face, with a tapered entry thereat, said upper surface of said upper part extending outwardly above said front plug face in a horizontally-planar tongue, said upper body further containing a vertical fastening aperture therethrough between said front plug face and said lower part, said lower part consisting of an elongated, cylindrical member extending orthogonally-downward from said lower surface of said upper part and being truncated at its distal end in a horizontally-planar, lower plug face having a connector keying feature formed thereon and a plurality of open-ended recesses formed therein;

a plurality of electrical conductors molded into said insulating body, said conductors passing internally through said insulation body from said upper front plug face to said lower plug face, said conductors having first and second ends configured into male connector pins, said first ends extending orthogonally outward from said upper front plug face for a predetermined length, said second ends extending downward for a predetermined length and each being contained within one of said open-ended recesses behind said horizontal lower plug face;

a wraparound, C-shaped reinforcing part having a pair of parallel, spaced, horizontally-planar, rectangular upper and lower fingers, said fingers being connected at their rear edges by a bifurcated, vertical member to hold said fingers apart, said lower finger having a first cylindrical aperture therein, said first cylindrical aperture being dimpled downward about its periphery, said upper and lower fingers each containing a fastening aperture therethrough at their front edges which are opposed and aligned with one another and with said vertical fastening aperture through said upper part;

an open-ended, cylindrical bearing tube having an inner diameter slightly larger than the outer diameter of said cylindrical part of said insulator body and having a flange at its upper end;

an over-center, spring-latching member having a planar base for mounting, with a fastening aperture in alignment with said fastening apertures in said upper part and said wraparound part, an inclined-ramp upper surface extending outwardly into an inverted V, said inverted V having a tool-engagement hole in the rearward leg thereof for depressing said latching member downward;

wherein said lower part of said insulating body passes through said cylindrical bearing tube and extends downward therefrom to expose a portion of said cylindrical part, including said keyed, lower plug face extending therethrough, said lower surface of said upper part resting against said flanged end of said bearing tube and is rotatably-supported thereby, said bearing tube extending downward through said first cylindrical aperture through said lower finger of said wraparound part, said flared end being contained in said downward-dimpled periphery of said first cylindrical aperture and rotatably-supported thereby, said lower surface of said upper part of said insulator body further being supported by said lower finger of said wraparound member, said upper finger of said wraparound member contacting said upper surface of said upper part of said insulator body and said bifurcated, vertical member of said wraparound member contacting said vertical rear face of said upper part to grip said upper part between said fingers of said channel part, said over-center latching member being mounted to said upper surface of said upper part; and fastener means passing through said fastener apertures in said over-center member, said upper part of said insulator body and said fingers of said wraparound part to hold said parts of said assembly together;

a female socket assembly for connection with said combination hinge pin and plug within said door, including:

a female connector body made of an insulating material and having a plurality of apertures therethrough, said insulating body being keyed for mating engagement with said lower plug face of said hinge pin and plug assembly;

a plurality of female contact pins inserted within said apertures in said female connector body and adapted to penetrate said open-ended recesses through said lower plug face and to receive said male connector pin ends of said lower cylindrical part of said hinge pin and plug assembly; and a combination mounting receptacle and socket assembly to receive said combination hinge pin and plug assembly in a plug-in fashion and for mounting said pin assembly to said appliance, including:

a female channel member having a horizontal planar base containing a plurality of fastener apertures therethrough, a pair of vertical sides extending downward from said base, an open front and rear, and a pair of opposed, horizontal sliding members running the length of said vertical sides, said horizontal sliding members being adapted for sliding engagement within said horizontal grooves in said upper part of said insulator body in said combination hinge pin and plug assembly, said open front adapted for receiving said front face of said hinge pin plug and said horizontally-planar tongue for horizontal sliding engagement therethrough;

a female connector, including an insulating connector body having a flange containing a plurality of mounting apertures therethrough for mounting said insulator body to said appliance, a vertically-planar connector face, a plurality of contact-receiving apertures through said connector body;

a plurality of female contact pins inserted within said connector body, each adapted to receive said male connector pins extending from said front face of said combined hinge pin and plug assembly;

said female structural member being mounted in an outward-facing direction to receive said plug-in hinge pin and plug, said female connector being mounted behind said female structural member such that said connector face is aligned with said open rear of said structural member to receive and mate with said plug face of said hinge pin and plug assembly; and mounting fastener means to fasten said female structural member and said female connector to said appliance;

wherein said appliance contains a plurality of apertures therethrough to receive said mounting fastener means, said appliance further containing at least one aperture adapted to receive and retain said inverted V of said over-center spring member when said combined hinge pin and plug assembly is installed.

9. A hinge pin assembly for hinging a door to a door-frame, comprising:

an elongated hinge pin having one end for attachment to said door-frame and a second end for insertion into said door, for hinging said door thereabout;

means located at said one end of said hinge pin for slidably connecting said hinge pin to said door-frame, said sliding connection being in a direction perpendicular to the plane of the door-frame;

means adapted for attachment to said door-frame for slidably receiving said slidably connecting means in said perpendicular direction;

means for fastening said slidably connecting means to said receiving means;

said connecting means further including a body adapted for sliding engagement with said receiving means, said body having a front surface and side surfaces adapted for guiding said body into male/-female sliding engagement with said receiving means and for resisting lateral forces applied through said hinge pin;

said receiving means further including a body for receiving said connecting body in said sliding engagement therewith, said receiving body having an opening to receive said connecting body and side surfaces adapted for guiding said receiving body in said male/female sliding engagement therewith and for resisting said lateral forces applied through said hinge pin; and wherein said connecting body and said hinge pin are made as one piece.

10. The device in claim 9, further comprising:

a bearing sleeve for insertion in said door within which said hinge pin is rotatively-contained for reinforcing said hinge pin, having an internal surface adapted for low-friction sliding with said hinge pin exterior surface.

11. The device of claim 9 further comprising:

conductor means extending through said connecting body and said hinge pin for conducting electrical power from said connecting body front surface to said hinge pin second end, further including means for making sliding electrical connection at said connecting body front surface between said conductor means and said receiving means; and wherein said receiving means further includes connector means for making sliding electrical connection with said conductor means.

12. A hinge pin and double-ended electrical plug and a mating receptacle therefor, for hinging a door containing an electrical socket and a bearing hole to a door frame, comprising:

a channel member, mounted rigidly to said door frame, open at the bottom, front and rear, having a pair of opposed side walls having a pair of opposed, inward-facing, sliding fingers thereon;

female electrical connector means for electrically connecting said door to said door frame, mounted to said door frame and having a connector face aligned with said open rear of said channel member, further including a plurality of means for making sliding electrical contact thereat;

an integrated plug-in hinge pin and electrical plug body having an upper, male, plug-in part and a a lower, cylindrical hinge pin part extending orthogonally-downward therefrom, said upper part having an electrical connector face for mating with said female connector means, a forward-extending tongue for sliding-engagement between said opposed sidewalls of said channel part and with said female connector means, and a pair of grooves in its side for sliding engagement with said inward-facing fingers of said channel member, said lower hinge pin part extending through said bearing hole of said door for hinging said door thereabout and being adapted at its lower end in a downward-facing male plug face keyed for electromechanical engagement with said electrical socket contained within said door, said electrical socket containing a plurality of means for making sliding electrical contact therewith;

a plurality of electrical conductors contained internally of said hinge pin and connector body and being electrically isolated therefrom, said conductors terminating at said upper part connector face in means for making sliding electrical contact thereat with said means for making sliding electrical contact in said female connector means and behind said downward-facing male plug face in means for making sliding electrical contact thereat with said means for making sliding electrical contact in said electrical socket; and fastening means for fastening said upper body into said channel member after said plug-in engagement thereof.

13. The device of claim 12, wherein:

said channel member further includes a third, internal wall equally spaced between said pair of opposed sidewalls, said internal wall having a pair of oppositely-facing walls which face said pair of opposed sidewalls and a pair of outward-facing, sliding fingers thereon to oppose said pair of opposed inward-facing sliding fingers on said pair of sidewalls to form a pair of side-by-side channels to receive a pair of said combination plug-in hinge pin and electrical connectors in a side-by-side, plug-in engagement; and said female electrical connector means is further adapted for electrically connecting said pair of combination plug-in hinge pin and electrical connectors in said side-by-side engagement.

14. The device of claim 12, further comprising:

a wraparound, reinforcing member for said upper part, formed in the shape of a C, and wrapping over the top, around the rear, and under the bottom of, said upper part to leave said front connector face, said tongue, and said side grooves of said upper body exposed for sliding engagement, said wraparound member further containing an aperture through its lower surface which is dimpled downward at the periphery thereof for the insertion of said lower body therethrough; and a tubular, reinforcing and bearing sleeve through which said lower hinge pin part extends, said sleeve having a flange at one end, said flange being retained within said downward-dimpled periphery of said reinforcing member to permit rotation thereof, and a slight pivotal movement of said sleeve and said hinge pin part therein in a lateral direction, without breaking.

* * * * *